US005571145A

United States Patent [19]

Drebin

[11] Patent Number: 5,571,145

[45] Date of Patent: Nov. 5, 1996

[54] RIGID ELECTRICAL PLUG ASSEMBLY WITH STRAIN RELIEF

[75] Inventor: Kelly B. Drebin, Amity, Oreg.

[73] Assignee: Hewlett-Packard Company, Palo Alto, Calif.

[21] Appl. No.: 310,184

[22] Filed: Sep. 21, 1994

[51] Int. Cl.[6] ..... H01R 13/56; H01R 13/58

[52] U.S. Cl. ..... 607/37; 439/472; 439/452; 439/76.1

[58] Field of Search ..... 128/640, 637, 128/639; 607/36, 37, 38; 439/452, 445, 76, 494, 460, 404, 472; 372/36, 38; 16/385; 333/248

[56] References Cited

U.S. PATENT DOCUMENTS

| | | | |
|---|---|---|---|
| 3,745,509 | 7/1973 | Woodward et al. | 439/76 |
| 4,255,006 | 3/1981 | King | 439/452 |
| 4,389,082 | 6/1983 | Lingaraju | 439/472 |
| 4,538,617 | 10/1985 | Jensen | 128/640 |
| 4,545,090 | 10/1985 | Redmond | 16/385 |
| 5,320,557 | 6/1994 | Gizienski | 439/445 |

FOREIGN PATENT DOCUMENTS

| | | |
|---|---|---|
| 2170058 | 7/1986 | United Kingdom . |

*Primary Examiner*—Angela D. Sykes
*Assistant Examiner*—Stephen Huang
*Attorney, Agent, or Firm*—Curtis G. Rose

[57] ABSTRACT

An electrical plug assembly comprises an electrically conductive tip, secured to a cable by an electrical conductor. A rigid housing portion encloses the tip, conductor, and a portion of the cable and possesses sufficient strength to protect the electrical conductor from breakage. The tip is non-rotatably coupled to the rigid portion. A strain relief portion is formed of material more flexible than the rigid portion and is non-rotatably coupled thereto. The strain relief portion partially encloses the cable to relieve strain applied to the cable.

14 Claims, 2 Drawing Sheets

RIGID ELECTRICAL PLUG ASSEMBLY WITH STRAIN RELIEF

BACKGROUND OF INVENTION

1. Technical Field

The present invention relates generally to the electronics field. More specifically, this invention relates to plug assemblies for use with electrical equipment to connect a cable from an electrical apparatus to another apparatus.

2. Description Of The Related Art

Electrical plug assemblies are in common use with a variety of electrical equipment, including equipment utilized in sensing or gathering data, such as an electrocardiograph, in which the plug is connected to an electrode probe, which in turn is secured to the chest of a patient to gather heartbeat data for producing an electrocardiogram. Such plug assemblies generally comprise an elongate, electrically conductive tip at one end of the plug assembly. The opposite end of the plug assembly is connected to an electrical cable. The intermediate portion of the plug assembly forms a handle for manipulation of the plug assembly.

In addition to its function as a plug, the plug assembly must protect the often delicate connection between the electrical cable and the electrically conductive tip. This connection may comprise a crimp or a solder joint; in either case, the connection is subject to failure if exposed to repeated bending and torsional loads applied in operation. Thus, the plug assembly should possess sufficient rigidity to protect the connection from failure due to bending and torsional loads. This function becomes even more important if an impedance-matching resistor or other electrical circuitry is provided between the cable and tip because the circuitry necessitates additional delicate connection points and separate electrical elements, all of which are subject to failure. However, the plug assembly cannot be wholly rigid, or else it will induce excessive strain at the juncture between the plug assembly and the electrical cable. This strain can cause electrical shorts or opens resulting in a premature failure of the electrical cable.

United Kingdom Patent Application No 2,170,058, published Jul. 23, 1986, discloses an electrical connector having one end adapted for connection to a thermocouple and an opposing end connected to a semi-rigid electrical cable. The connector includes concentric inner and outer tubes, the inner tube being coupled to the cable and the outer tube forming the housing of the connector. The inner and outer tubes are rotatable relative to one another to permit the connector to be rotated relative to the semi-rigid electrical cable so that the connector can be oriented independently of the semi-rigid cable for installations in which the final orientation of the connector relative to the thermocouple is uncertain. This disclosure demonstrates the difficulty in achieving the appropriate compromise between a rigid electrical connector and one that is sufficiently flexible to permit the connector or plug to be used in a variety of orientations without inducing undue strain on the cable to which it is attached. Because this disclosure is directed to use with semi-rigid cables, no strain relief means is provided, presumably because the semi-rigid cables are not subject to failure due to strain encountered in operation, as is the case with electrical cables connected to electrical plug assemblies, particularly those employed in conjunction with an electrocardiograph probe, in which the plug assembly and cable may be subjected to a relatively great amount of handling and manipulation during their operational lives.

A need exists, therefore, for an electrical plug assembly possessing sufficient rigidity to protect the electrical connections between the electrical cable and the electrically conductive tip from failure such as from bending, tension, and torsional loads, while simultaneously possessing sufficient flexibility and strain relief capability to prevent failure of the flexible electrical cable such as from strains encountered in operation. The electrical plug assembly should also be manufactured easily at low cost.

SUMMARY OF THE INVENTION

One aspect of the present invention is to provide an electrical plug assembly for use with an electrical apparatus, in particular an electrocardiograph. This and other aspects of the present invention are accomplished by providing a plug assembly having an electrically conductive tip, which is coupled to a flexible cable by an electrical conductor. A rigid housing portion encloses the tip, conductor, and a portion of the cable, and possesses sufficient strength to protect the conductor from breakage. The tip is nonrotatably coupled to the rigid portion. A strain relief portion is formed of material more flexible that the rigid portion and is non-rotatably coupled thereto. The strain relief portion partially encloses the cable to relieve strain applied to the cable.

According to the preferred embodiment of the present invention, the exterior of the rigid portion is provided with at least one circumferential land and at least one longitudinal land, the lands engaging the strain relief portion to prevent axial movement and rotation of the strain relief portion relative to the rigid portion.

Other aspects, features and advantages of the present invention will become apparent with reference to the detailed description, which follows.

DETAILED DESCRIPTION OF PREFERRED EMBODIMENT

Figure 1:
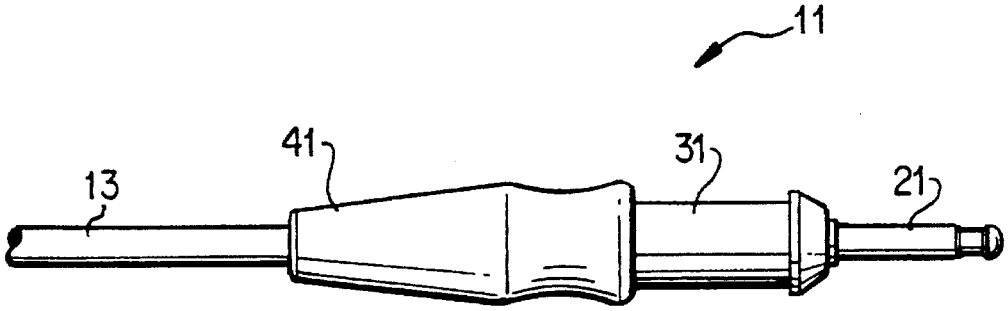
FIG. 1 is an elevation view of the electrical plug assembly of the preferred embodiment of the present invention.

With reference now to the figures and specifically to FIG. 1, an electrical plug assembly 11 is illustrated. Plug assembly 11 is connected at one end to a flexible insulated electrical cable 13 which, in the preferred embodiment, is connected to an electrocardiograph (not shown). Electrically conductive tip 21 extends from an opposite end of plug assembly 11. Tip 21 is preferrably adapted for connection to one of a plurality of conventional types of electrode probes (not shown) for use with the electrocardiograph. According to other embodiments of the invention, other tips, such as phone plug tips, phono plug tips, or the like may be used. A rigid portion or housing 31 encloses the connection between cable 13 and tip 21 and is formed of a material having strength sufficient to protect the connection against breakage. A conical, resilient, flexible strain relief portion 41 encloses a portion of cable 13 to relieve strain applied to cable 13 due to bending through arcs of reduced radius in operation.

Figure 2:
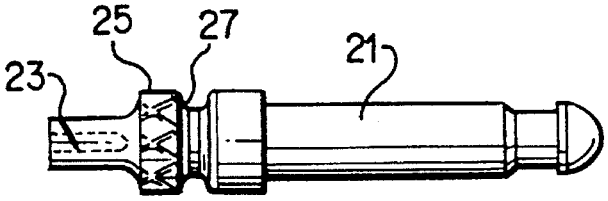
FIG. 2 is an enlarged elevation view of the electrically conductive tip portion of the electrical plug assembly illustrated in FIG. 1.

FIG. 2 is an enlarged elevation view of electrically conductive tip 21. One end 23 of tip 21 has a cylindrical recess formed therein to receive an electrical conductor connected to cable 13. According to preferred embodiment of the present invention, end 23 is crimped about the electrical conductor to secure tip 21 thereto. To avoid stress concentration, fillet 27 connects an enlarged-diameter portion 25 of tip 21 to end 23. Enlarged diameter portion 25 is knurled to secure tip 21 against rotation within the rigid housing 31. Fillet 27 is provided in enlarged-diameter portion 25 of tip 21 to secure tip 21 against axial movement relative to rigid housing 31.

Figure 3:
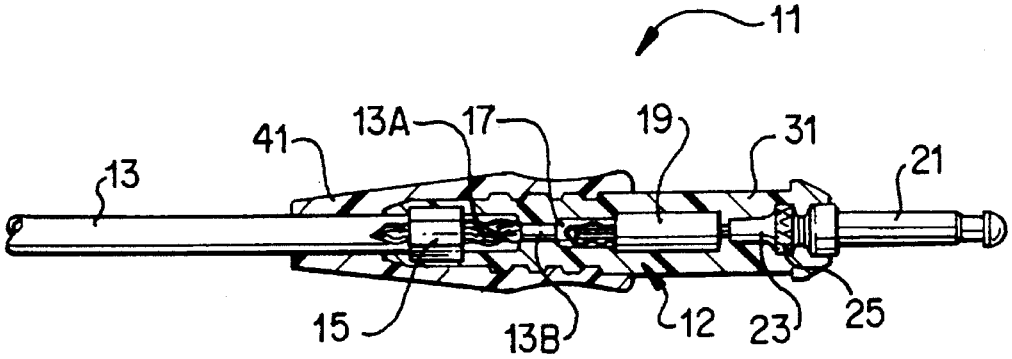
FIG. 3 is a longitudinal section view of a portion of the electrical plug assembly of FIG. 1.

FIG. 3 is a longitudinal section view of strain relief portion 41, rigid housing 31, cable 13, and tip 21 of plug assembly 11 of the preferred embodiment of the invention. Rigid housing 31 is preferably formed of approximately 40% glass-filled polybutylene terephthalate, although other materials could be used. Housing 31 is molded about the connection between electrical cable 13 and tip 21. A ferrule 15 is crimped on the exterior of electrical cable 13 to secure shielding wire 13A of cable 13 away from wire 13B and to provide an enlarged-diameter portion which prevents relative axial movement between electrical cable 13 and rigid housing 31 when rigid housing 31 is molded about cable 13. Wire 13B is part of and extends from cable 13 and is connected by a crimped ferrule 17 to one lead of electronic circuitry, shown here as impedance-matching resistor 19. Those skilled in the art will appreciate that other electronic circuitry, such as transistors, diodes, capacitors, integrated circuits, etc., could be used instead of or in addition to impedance-matching resistor 19 and still fall within the spirit and scope of the invention. The other lead of resistor 19 in turn is received in end 23 of tip 21 and is secured thereto by another crimp. Thus, generally cylindrical rigid housing 31 is molded about and encloses a portion of cable 13, conductor 12 (including electrical wire 13B, ferrule 17, and impedance-matching resistor 19), and a portion of tip 21. For purposes of this invention, the term "conductor" shall encompass all elements between the stripped end of cable 13 and end 23, whether or not resistor 19 or other intervening active or passive electronic circuitry is provided. For example, an alternate embodiment is contemplated where conductor 12 is merely wire 13B either crimped or soldered directly to end 23.

Engagement of knurled enlarged portion 25 and recess 27 with rigid housing 31 secures tip 21 against rotational and axial movement, respectively, relative to rigid housing 31. Conductor 12 thus is protected against bending, tensile, torsional loads or other loads that may be encountered by electrical plug assembly 11 and renders it less susceptible to mechanical and electrical failure.

Figure 4:
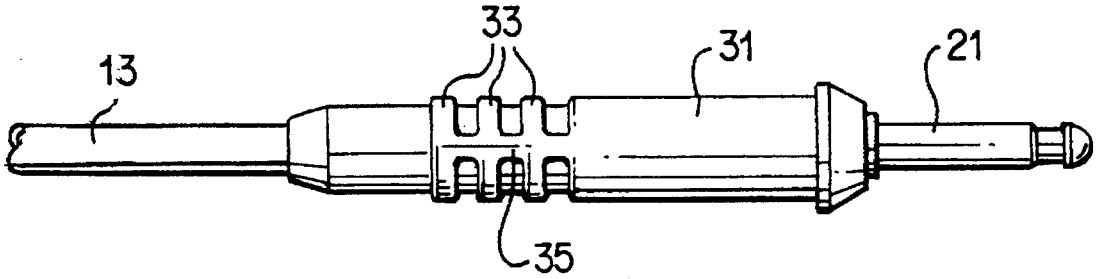
FIG. 4 is an elevation view of the rigid housing of the electrical plug assembly illustrated in FIG. 1.

FIG. 4 is an elevation view of the exterior of rigid housing 31. Rigid housing 31 is molded with at least one radially enlarged circumferential land 33 and at least one longitudinally extending land 35. A generally conical, resilient, and flexible strain-relief portion 41, (FIG. 3) preferably molded of polyvinyl chloride, is molded about the rear or cable end portion of rigid housing 31 and a portion of electrical cable 13. Strain relief portion 41 prevents cable 13 adjacent to plug assembly 11 from being bent in a small radius in operation and prevents failure of cable 13 due to such bending. As illustrated in FIG. 3, strain relief portion 41 is secured against rotation and axial movement relative to rigid housing 31 and tip 21. Alter strain relief portion 41 is molded about rigid housing 31, engagement between the material of strain relief portion 41 and lands 33, 35 secures strain relief portion 41 against rotation and axial movement relative to rigid housing 31 and tip 21.

Plug assembly 11 is manufactured employing resin transfer molding techniques. First, ferrule 15 is crimped about cable 13 to secure shield wire 13A. Then ferrule 15 is crimped about electrical wire 13B of cable 13 and one lead of resistor 19 and end 23 of tip 21 is crimped about the opposite lead of resistor 19. Thus connected, cable 13 and tip 21 are disposed in a conventional resin transfer molding (RTM) apparatus.

The mold apparatus then is injected with a glass-filled resin themoplastic, which encapsulates a portion of cable 13, tip 21, and conductor 12. Upon curing, rigid housing 31 of plug assembly 11 is formed and has strength sufficient to protect conductor 12 against breakage. Also during the molding of rigid housing 31, circumferential and longitudinal lands 33, 35 are formed.

Next, the assembly, including cable 13, tip 21, and rigid housing 31, is disposed yet in another RTM apparatus, and resilient thermoplastic resin is injected into the mold to form strain relief portion 41. The resilient material encloses and encapsulates lands 33, 35 on the exterior of rigid housing 31, wherein, upon curing, strain relief portion 41 engages lands 33,35 and is secured against axial and rotational movement relative to rigid housing 31 and tip 21.

Figure 5:
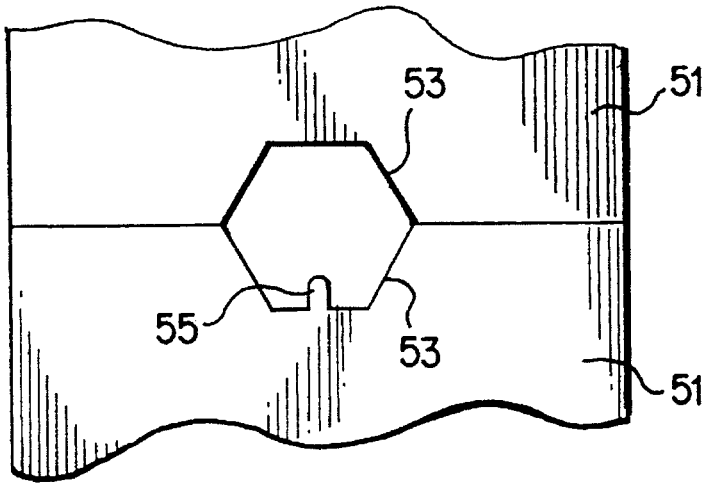
FIG. 5 a fragmentary elevation view of a preferred crimping tool employed in the manufacture of the electrical plug assembly according to the preferred embodiment of the present invention.

FIG. 5 is a partial elevation view of jaws 51 of a crimping tool preferred for connecting end 23 of tip 21 to one lead of resistor 19. As FIG. 2 shows, end 23 of tip 21 has a cylindrical recess foraged therein to receive one lead of resistor 19, which is also cylindrical in shape. Each jaw 51 is formed in the shape of one-half of a hexagon 53, wherein upon closure together of jaws 51 a full hexagon is formed having an effective diameter less that that of the portion to be crimped. A projection 55 extends from the bottom of one of jaws 51 to provide a protrusion of a small area, which semi-pierces the end 23 of tip 21 during the crimping operation. Semi-piercing end 23 of tip 21 during the crimping operation deforms the lead of resistor 19 to a non-cylindrical shape, thereby resulting in increased security against rotational movement.

An alternate embodiment has been contemplated where the connections are soldered using conventional soldering techniques instead of crimped.

The electrical plug assembly according to the present invention possesses a number of advantages. Principally, the plug assembly possesses sufficient strength and rigidity to protect the conductor between the tip and electrical cable.

The plug assembly is also provided with a strain relief portion to prevent damage to the electrical cable. Further, the electrical plug assembly is manufactured easily at low cost.

What is claimed is:

1. A plug assembly for use with electrical equipment, said plug assembly comprising:

a tip;

a flexible cable secured to said tip by an electrical conductor;

a wholly rigid portion enclosing a portion of said tip, said conductor, and a portion of said cable, said wholly rigid portion having strength sufficient to protect at least said conductor from breakage, said tip being nonrotatably coupled to said wholly rigid portion; and a strain relief portion formed of material more flexible than said wholly rigid portion, said strain relief portion being nonrotatably coupled to said wholly rigid portion and partially enclosing said cable to relieve strain applied to said cable due to said cable being bent in a small radius adjacent to said plug assembly.

2. The plug assembly according to claim 1 wherein said rigid portion is molded of glass-filled plastic material.

3. The plug assembly according to claim 1 wherein said strain relief portion is molded of polyvinyl chloride.

4. The plug assembly according to claim 1 wherein said electrical conductor comprises a wire.

5. The plug assembly according to claim 4 wherein said electrical conductor further comprises electronic circuitry.

6. The plug assembly according to claim 5 wherein said electronic circuitry comprises an impedance-matching resistor.

7. The plug assembly according to claim 1 wherein said tip is for connection to an electrocardiograph electrode probe.

8. A plug assembly for use with electrical equipment, said plug assembly comprising:

a tip;

a flexible cable secured to said tip by an electrical conductor:

a rigid portion enclosing a portion of said tip, said conductor, and a portion of said cable, said rigid portion having strength sufficient to protect at least said conductor from breakage, said tip being nonrotatably coupled to said rigid portion;

a strain relief portion formed of material more flexible than said rigid portion, said strain relief portion being nonrotatably coupled to said rigid portion and partially enclosing said cable to relieve strain applied to said cable;

wherein said rigid portion has a first end from which said tip extends and a second end from which said cable extends and an exterior provided with at least one circumferential land and at least one longitudinal land for engagement with said strain relief portion, said lands preventing axial movement and rotation of said strain relief portion relative to said rigid portion.

9. The plug assembly according to claim 8 wherein said rigid portion is molded of glass-filled plastic material.

10. The plug assembly according to claim 8 wherein said strain relief portion is molded of polyvinyl chloride.

11. The plug assembly according to claim 8 wherein said electrical conductor comprises a wire.

12. The plug assembly according to claim 11 wherein said electrical conductor further comprises electronic circuitry.

13. The plug assembly according to claim 12 wherein said electronic circuitry comprises an impedance-matching resistor.

14. The plug assembly according to claim 8 wherein said tip is for connection to an electrocardiograph electrode probe.

* * * * *